United States Patent [19]

Muns-Magem et al.

[11] 4,364,247

[45] Dec. 21, 1982

[54] YARN CONDITION SENSING DEVICE

[76] Inventors: Joaquin Muns-Magem; Juan Ibanez-Pi, both of Burgos, 3, Rubi, (Barcelona), Spain

[21] Appl. No.: 181,504

[22] Filed: Aug. 26, 1980

[30] Foreign Application Priority Data

Mar. 25, 1980 [ES] Spain ..... 249.980

[51] Int. Cl.[3] ..... D04B 35/12; D04B 35/14; D04B 35/16

[52] U.S. Cl. ..... 66/163; 139/353

[58] Field of Search ..... 66/163, 161, 157; 112/273; 139/353

[56] References Cited

U.S. PATENT DOCUMENTS

| | | | |
|---|---|---|---|
| 1,942,524 | 1/1934 | Welch et al. | 66/163 |
| 2,010,928 | 8/1935 | Quick | 66/163 |
| 2,777,026 | 1/1957 | Vossen | 66/163 X |
| 4,275,574 | 6/1981 | Muns | 66/163 |

*Primary Examiner*—Ronald Feldbaum
*Attorney, Agent, or Firm*—Sughrue, Mion, Zinn, Macpeak & Seas

[57] ABSTRACT

The yarn condition sensing device is comprised of a plurality of thin flat forks pivoted at one end thereof between a plurality of closely spaced apart plates protruding from one side of a reed. The opposite end of each fork is provided with a yarn guide aperture for sensing a plurality of yarns under tension. A pair of parallel electrical contacts are secured along the top and bottom edges respectively of the reed which will produce a suitable warning or control signal if contacted by the pivoted fork upon variation in the tension of a single yarn. If the tension of a yarn increases undesirably, the fork engaged with said yarn will be pivoted upwardly into engagement with the electrical contact along the top edge of the reed. if a yarn should break, the fork engaged therewith will fall downwardly into engagement with the electrical contact disposed along the bottom edge of said reed. A plurality of holes are located in a line along the end of the fork opposite the yarn receiving aperture for selectively varying the pivot axis of said forks and for the reception of a suitable locking pin.

6 Claims, 12 Drawing Figures

FIG. 1
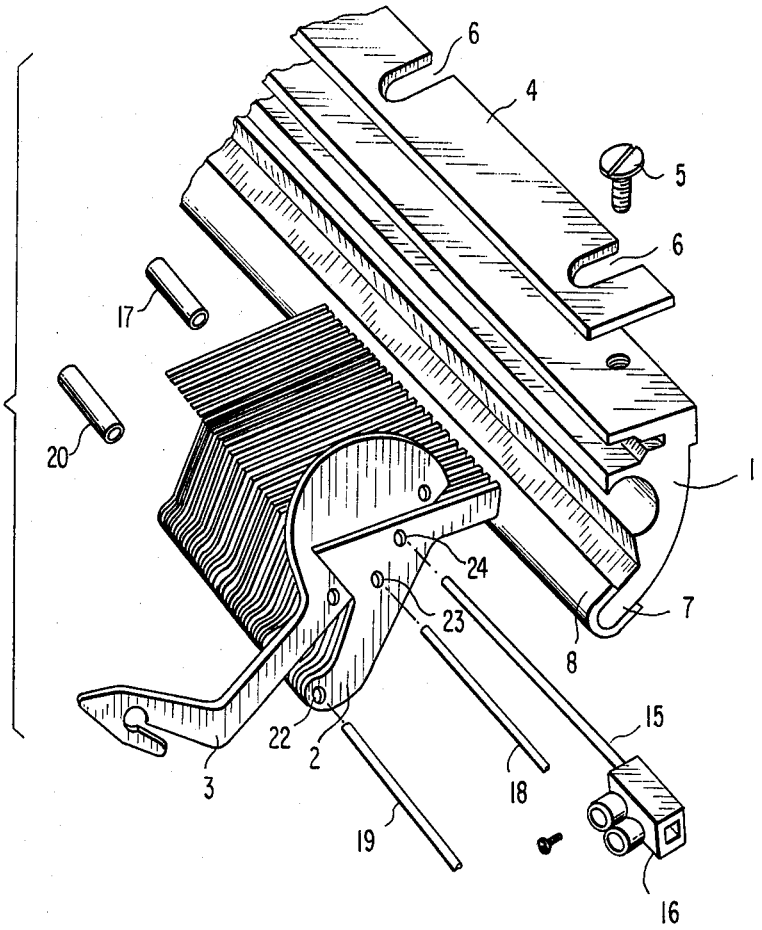
FIG. 2a
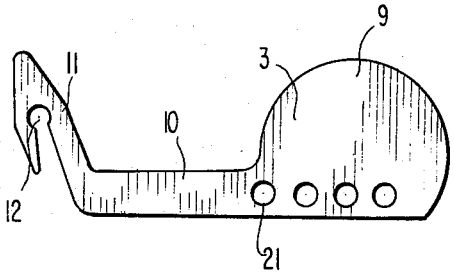
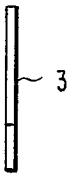
FIG. 2b
FIG. 3a
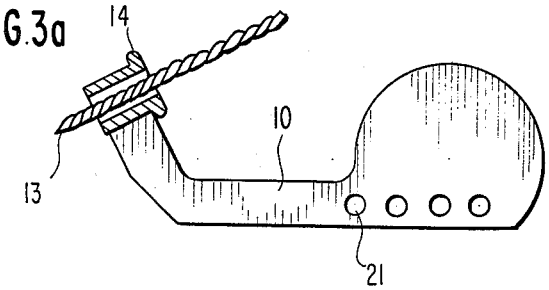
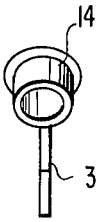
FIG. 3b FIG. 7
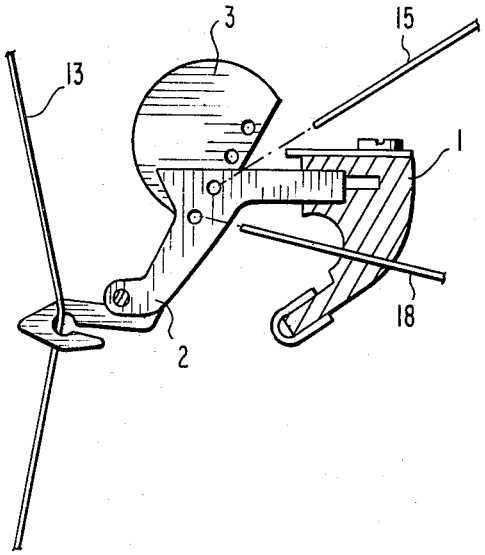
FIG. 8
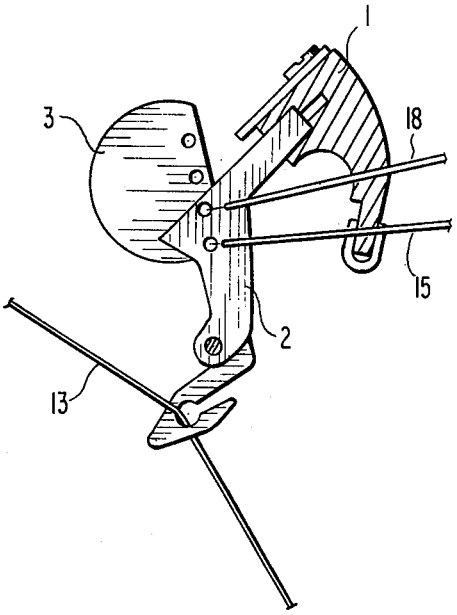
FIG. 9
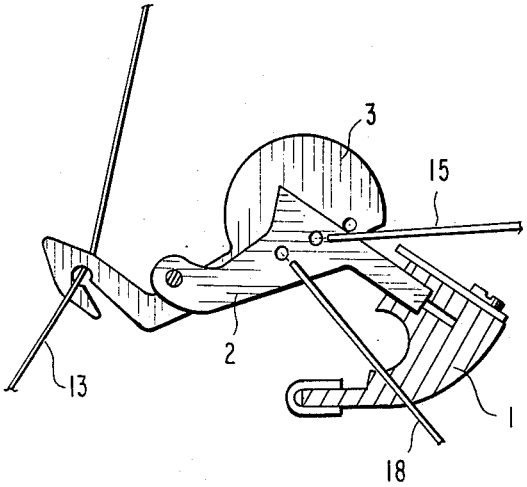
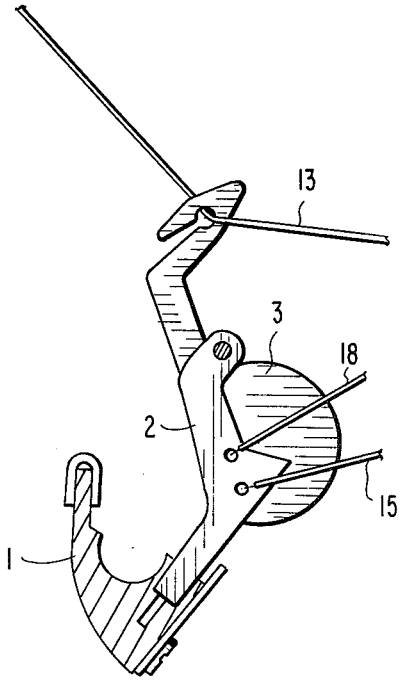
FIG. 10

YARN CONDITION SENSING DEVICE

BACKGROUND OF THE INVENTION

The present invention is directed to an improved weft yarn fork particularly adapted for application to a warp knitting machine which makes it possible to stop the machine whenever a yarn breaks or is subjected to excessive tension. In either case, the machine will stop automatically so that a single operator can control several machines.

The improved weft yarn offers countless advantages over those of the conventional type allowing one employee to control several machines in that the constant monitoring of every yarn is unnecessary since the stoppage of the machine will be automatic thereby allowing the fault to be corrected before a defect of substantial proportions results.

The problem with weft yarn forks of the conventional type resides in the manner in which they are fitted which consists of putting them astride each yarn. This makes it necessary to introduce the yarns into the weft yarn forks one by one, a slow manual operation which delays starting of the machine. In contrast, rapid threading is possible with the weft yarn fork according to the present invention, thereby providing an improvement in productivity.

The improved weft yarn fork according to the present invention makes it possible to stop the machine not only when a thread breaks, which is comparable to conventional weft yarn forks, but also when one of the threads is subjected to excessive tensile stress generally due to abnormal unwinding of the thread from its cone or spool. This excessive tension likewise tends to cause a defect in the fabric and this is prevented since the weft yarn fork detects it and immediately stops the machine.

The size of the blades of the weft yarn fork and their extreme thinness makes possible the production of fabrics having a high density of yarns per centimeter and the yarns can also be of very fine gauge. All of this is beyond the usual capability of convention weft yarn forks.

SUMMARY OF THE INVENTION

The weft yarn fork according to the present invention is comprised essentially of a completely flat thin blade, the upper part of which is generally semi-circular and which has a number of holes aligned parallel to the straight side of said semi-circular part. The fork is provided with a straight section which is an extension of the straight side of said semi-circular part with the end of the straight section opposite the semi-circular part being bent at an obtuse angle on the same side thereof as said semi-circular part. An open-sided circular aperture is formed in the end of the angled portion which allows the insertion of the yarn therein. Each weft yarn fork is mounted intermediate a pair of flat closely spaced plates protruding from one side of a reed in a machine. Each flat plate is provided with a plurality of holes and a shaft may be selectively extended through aligned holes in each plate and each fork for pivoting each fork relative to the reed. The reed is provided with a pair of parallel electrical contacts along the top and bottom edges thereof respectively which are adapted to be engaged by each fork when it is pivoted in opposite directions. The fork is so designed and pivoted that in the rest position when it is not in contact with any yarn the fork will rest upon the contact disposed along the bottom edge of said reed. The location of the shaft upon which the forks are pivoted may be varied relative to the plates and the forks according to the desired positioning of the yarns in relation to the machine and also according to the denier of the yarn. A pin may also be inserted through selective aligned holes in said plates and said forks to lock the forks in a position which facilitates the insertion of the yarns into the apertures at the ends of said forks. For additional safety an additional pin may be inserted through aligned apertures in said plates parallel to the pivot shaft to prevent projection of the weft yarn forks which if occurred could be dangerous since the fork on retracting could remain astride the reed without making proper contact so that the machine would not stop when it should.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is an exploded perspective view of the improved weft yarn fork according to the present invention and the reed upon which it is pivoted.

FIG. 2*a* is a side elevation view of one form of weft yarn fork according to the present invention.

FIG. 2*b* is an end elevation view of the fork shown in FIG. 2 as viewed from the left.

FIG. 3*a* is a side elevation view of another form of the weft yarn fork according to the present invention.

FIG. 3*b* is an end elevation view of the fork shown in FIG. 3 as viewed from the left side thereof.

FIGS. 7, 8, 9 and 10 show views similar to FIG. 4 with the pivot shaft and locking pins spaced from the different apertures in which they can be located and with the reed in different angular orientations.

DETAILED DESCRIPTION OF THE INVENTION

Figure 4:
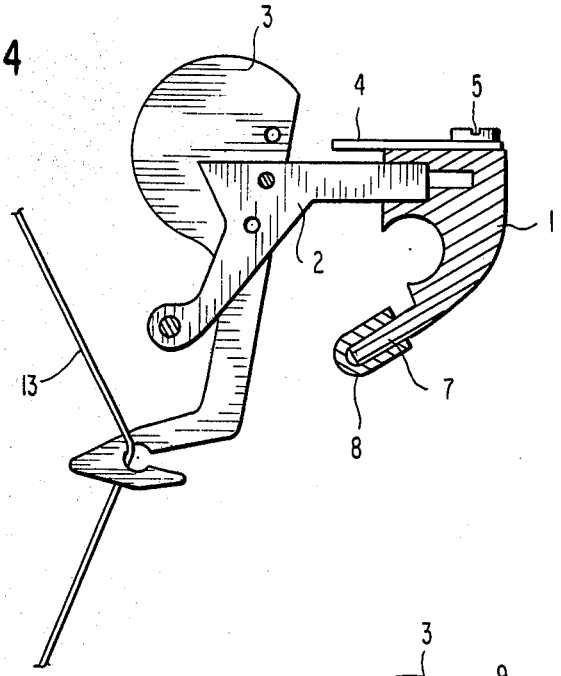
FIG. 4 is an end elevation view, partly in section, of the fork according to the present invention in its normal yarn sensing position relative to the reed.
Figure 5:
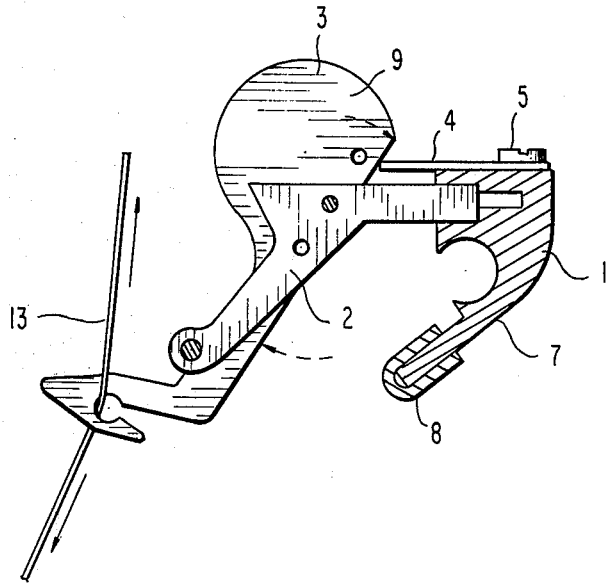
FIG. 5 is a view similar to FIG. 4 showing the position of the fork upon sensing excessive tension in the yarn.
Figure 6:
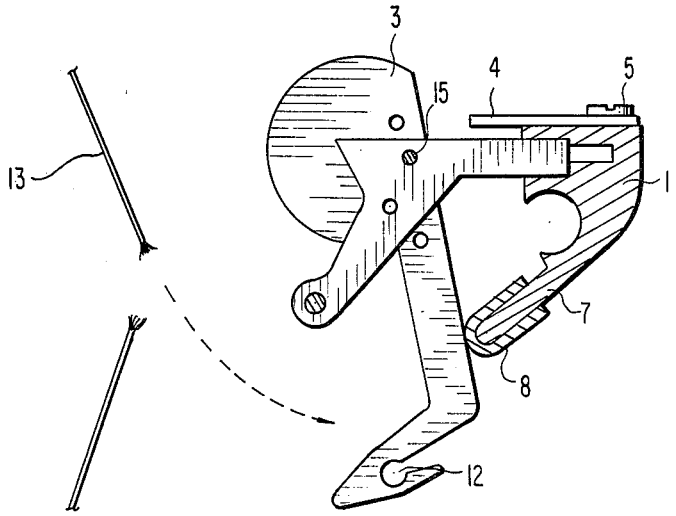
FIG. 6 is a view similar to FIG. 4 showing the position of the fork relative to the reed upon breakage of the yarn with which the fork was engaged.

As best seen in FIGS. 1–3 of the drawings, a reed 1 includes a plurality of closely spaced apart parallel plates 2 which extend from one side thereof. An electrical contact 4 is secured to the top of the reed 1 by means of screws 5 threaded into apertures in the top surface of the reed 1 and which are located in open slots 6 in the contact 4. This allows the contact 4 to be shifted forwardly and rearwardly until it is in the correct position with the proper amount of overhang as best seen in FIGS. 4–6. Another electrical contact strip 8 is secured to the bottom flange 7 of the reed 1 by any suitable means such as by clinching or by an adhesive. The electrical connections for the contact strips 4 and 8 have not been illustrated since these are old and well known in the art.

A weft fork 3 is located between each pair of adjacent plates 2 although only a single weft fork 3 has been illustrated in FIG. 1 for the sake of clarity. Each weft fork is comprised of a thin flat blade having an enlarged portion 9 the shape of which is generally that of a circle lacking a segment. A straight section 10 extends from one side of the enlarged portion with one edge thereof in alignment with the straight edge of the enlarged portion 9. The end 11 of the blade extends at an oblique angle relative to the straight section 10 on the same side thereof as the enlarged portion 9. An open-sided aperture 12 is located in the end portion 11 as best seen in FIG. 2 for the reception of a yarn 13. In the construction shown in FIG. 3, a cylindrical guide sleeve 14 is secured to the end of the blade in lieu of the aperture 12 for use with yarns 13 of greater coarseness.

For purposes of pivotally mounting the weft yarn forks 3 between the plates 2 of the reed 1, a plurality of holes 21 are aligned along the straight edge of the enlarged portion 9 of each fork 3. The holes 21 are equally spaced and disposed in a line parallel to the edge of the fork. Three holes 22, 23, and 24 are provided in each plate 2 with the corresponding holes in each plate being aligned for the reception of various pins and/or pivot shafts. The number of weft yarn forks to be pivotally mounted on the reed 1 varies according to the type of fabric to be produced. The pivot shaft 15 having an electrical contact 16 at one end thereof extends through the aligned holes 24 and a selected one of the holes 21 in the forks 3 to pivotally mount the forks 3 between the plates 2 and to connect each fork 3 to a source of electrical current. A stop 17 is detachably secured to the end of the shaft 15 to prevent the accidental withdrawal of the shaft during operation of the machine. If desired, a pin 18 can be passed through the holes 23 in the plates 2 and another of the holes 21 to keep the weft forks 3 away from the contact 8 during the threading operation. Likewise, another pin 19 can be inserted through the aligned holes 22 in the plates 2 for the purpose of preventing the forks 3 from protruding between the blades during operation. Suitable stops 20 can be detachably secured to the pins 18 and 19 for the purpose of holding them in place.

FIGS. 7, 8, 9 and 10 show different positions for the insertion of the pivot shaft 15 and the locking pin 18 according to the position of the yarn relative to the weft fork 3. These drawings facilitate an understanding of the need for a plurality of holes 21 in each weft fork so that the position of the mass of each weft fork can be varied in relation to the pivot shaft for the purpose of achieving complete contact and insuring the correct tension as a function of the coarseness of the yarn. It often becomes necessary to vary the position of the axis of rotation in accordance with the direction of entry of the yarn relative to the individual weft yarn forks.

The operation of the weft yarn fork according to the present invention can best be seen from FIGS. 4, 5 and 6. In FIG. 4 the yarn 13 is operating with the proper tension and a weft yarn fork 3 is maintained out of engagement with both electrical contacts 4 and 8. In FIG. 5, the yarn 13 has been subjected to undue tension, for example, from abnormal unwinding from its cone or spool. The increased tension causes the weft fork 3 to pivot in a clockwise direction as viewed in FIG. 5 so that the end portion 9 will make contact with the electrical contact 4 whereupon the machine will instantly stop to prevent a fault which such excessive tension might cause. The circuitry for stopping the machine upon engagement of the contacts is old and well known in the art and it is not deemed necessary to illustrate or describe the same in the present application. As pointed out previously, the position of the contact 4 can be varied by means of the open-ended slots 6 and the screws 5 so that the point of contact between the fork 3 and the contact 4 can be varied depending upon the permissible variations in the tension of the yarns.

In FIG. 6, the yarn 13 is shown in the broken condition which allows the weft fork 3 to pivot in counterclockwise direction due to the weight distribution of the fork relative to the pivot axis 15. Such pivotal movement brings the fork 3 into engagement with the contact 8 whereupon the machine will instantaneously be brought to a stop.

While the invention has been particularly shown and described with reference to preferred embodiments thereof, it will be understood by those in the art that the foregoing and other changes in the form and details may be made therein without departing from the spirit and scope of the invention.

What is claimed is:

1. A yarn condition sensing device for a knitting machine comprising an elongated reed having top and bottom edges and a plurality of flat parallel plates protruding from one side thereof, a pair of elongated electrical contacts secured to said top and bottom edges respectively of said reed, at least one flat elongated weft yarn fork having an enlarged portion adjacent one end, a straight central portion and a bent end portion having an open-sided aperture therein for the reception of a yarn, said weft yarn fork having a plurality of aligned holes along one edge of said enlarged portion and each of said plates having a plurality of holes aligned with each other, and shaft means having electrical contact means at one end thereof extending through aligned holes in said plate and a selected one of said holes in said fork for pivotally mounting said fork between a pair of adjacent plates whereby upon normal operation of said yarn said fork will be maintained out of engagement with both of said electrical contacts on said reed and upon abnormal functioning of said yarn said fork will be pivoted into engagement with one of said electrical contacts.

2. A yarn condition sensing device as set forth in claim 1 further comprising locking pin means extending through other aligned holes in said plates and a second hole in said fork for locking said fork against pivotal movement during threading of said yarn.

3. A yarn condition sensing device as set forth in claim 1 further comprising additional pin means extending thru other aligned holes in said plates to prevent said fork from protruding from the reed.

4. A yarn condition sensing device as set forth in claim 1 wherein the electrical contact secured to the top edge of said reed is comprised of a flat elongated plate having open-ended laterally extending slots and screw means engaged in said reed and passing through said open-ended slots whereby the position of said electrical contact may be adjusted to vary the spacing between said electrical contact and said fork during normal yarn functioning.

5. A yarn condition sensing device as set forth in claim 1 wherein the electrical contact secured to the bottom edge of said reed is comprised of an elongated U-shaped strip secured to a projecting flange at the bottom of said reed.

6. A yarn condition sensing device as set forth in claim 1 wherein the enlarged portion of said fork has a substantially semicircular configuration with said holes being aligned along the straight edge of said semi-circular portion and wherein the opposite end is bent at an obtuse angle from said straight section on the same side thereof as said enlarged portion for properly distributing the weight of said fork.

* * * * *